US008469348B2

(12) United States Patent
Saitsu

(10) Patent No.: US 8,469,348 B2
(45) Date of Patent: Jun. 25, 2013

(54) IMAGE FORMING SYSTEM

(75) Inventor: Yasushi Saitsu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 12 days.

(21) Appl. No.: 13/344,794

(22) Filed: Jan. 6, 2012

(65) Prior Publication Data

US 2012/0175835 A1 Jul. 12, 2012

(30) Foreign Application Priority Data

Jan. 12, 2011 (JP) ..... 2011-003762

(51) Int. Cl.
*B65H 37/04* (2006.01)

(52) U.S. Cl.
USPC ..... 270/58.1; 270/58.3; 270/58.07

(58) Field of Classification Search
USPC ..... 270/58.1, 58.3, 58.07, 58.11; 198/419.2, 198/418.9; 271/182, 189
See application file for complete search history.

(56) References Cited

U.S. PATENT DOCUMENTS 5,060,928 A * 10/1991 Vits ..... 271/182
6,199,850 B1 * 3/2001 Seki ..... 270/58.07
6,332,606 B1 * 12/2001 Seki ..... 270/59
7,946,582 B2 * 5/2011 Suh ..... 271/302
2008/0106032 A1 * 5/2008 Kanda ..... 271/279

FOREIGN PATENT DOCUMENTS

JP 2007-156406 A 6/2007

* cited by examiner

*Primary Examiner* — Leslie A Nicholson, III

(74) *Attorney, Agent, or Firm* — Holtz, Holtz, Goodman & Chick, P.C.

(57) ABSTRACT

An image forming system including an image forming section to print images on sheets; a conveyance path through which the printed sheets are conveyed; a post-processing section which executes post-processing to form a booldet from a bundle of sheets conveyed through the conveyance path; a plurality of overlapping sections each of which is disposed between the image forming section and the post-processing section, makes the sheets temporarily wait, forms a bundle of sheets by overlapping a plurality of waiting sheets, and conveys to the post-processing apparatus; a control section which, with respect to a second or later booldet set in case of continuously forming booldet sets, controls a number of the sheets to be conveyed to the overlapping section, a conveying order of the sheets, and a timing to convey the sheets to a downstream side, based on a period of executing the post-processing.

6 Claims, 12 Drawing Sheets

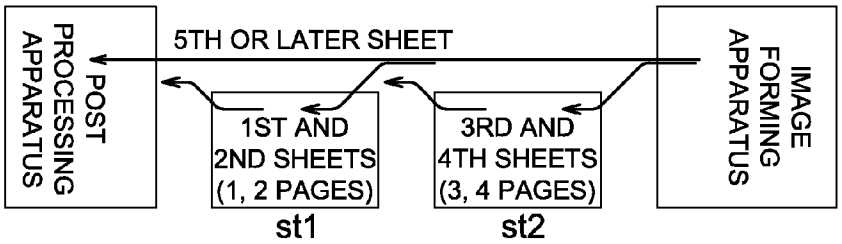
FIG. 5a
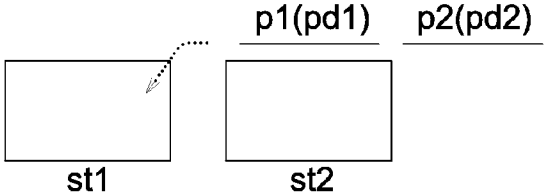
FIG. 5b1
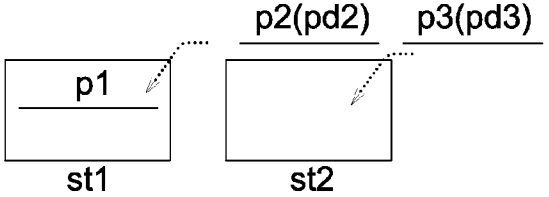
FIG. 5b2
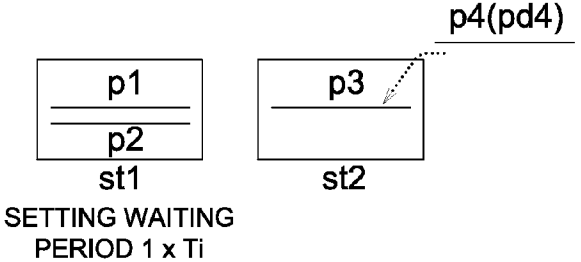
FIG. 5b3
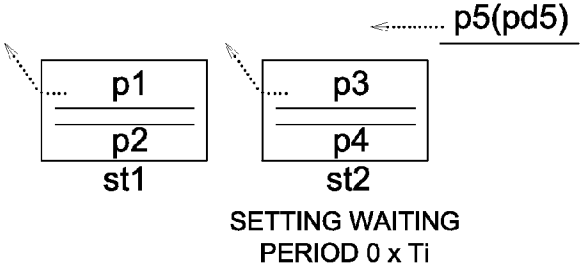
FIG. 5b4
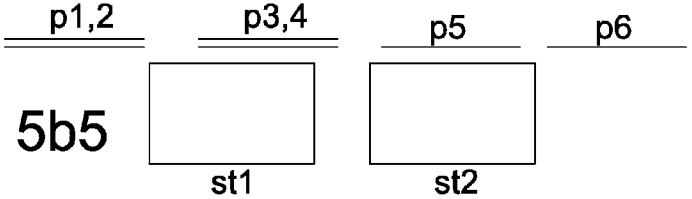
FIG. 5b5

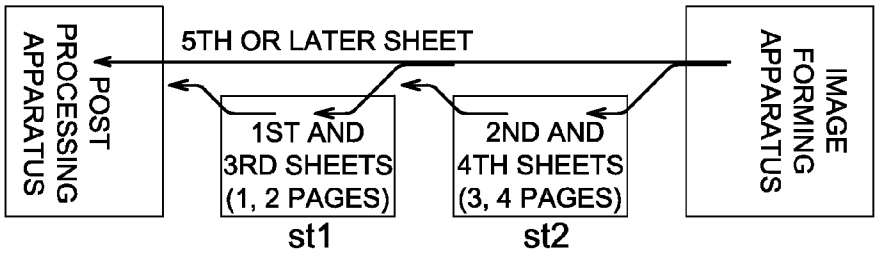
FIG. 9a
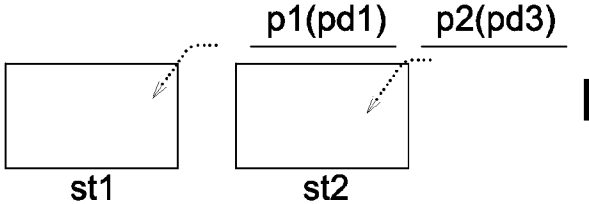
FIG. 9b1
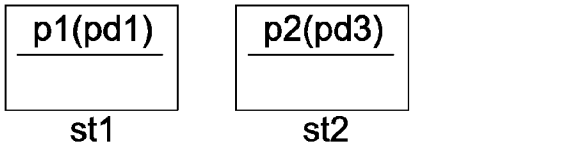
FIG. 9b2
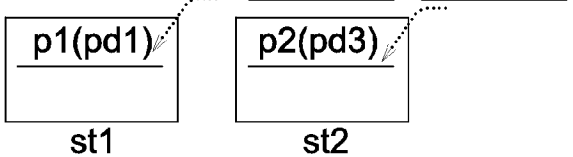
FIG. 9b3
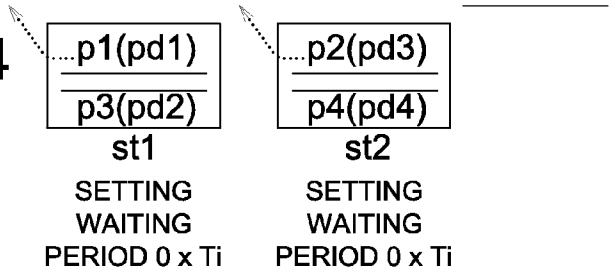
FIG. 9b4
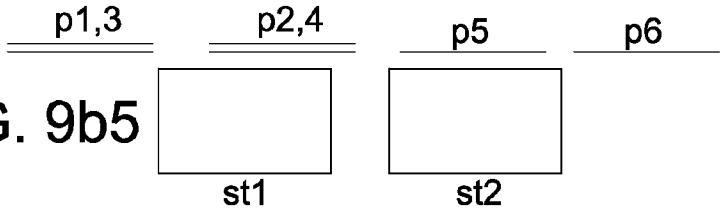
FIG. 9b5

IMAGE FORMING SYSTEM

CROSS REFERENCE TO RELATED APPLICATION

The present application is based on Japanese Patent Application No. 20011-003762 filed with Japanese Patent Office on Jan. 12, 2011, the entire content of which is hereby incorporated by reference.

BACKGROUND OF THE INVENTION

1. Technical Field

The present invention relates to an image forming system provided with a plurality of overlapping sections which overlap multiple printed sheets for making a bundle of sheets and convey the bundle of sheets toward a post processing apparatus.

2. Background Technology

An image forming apparatus, such as an electrophotographic image forming apparatus, to form images on sheets with high speed, is enabled to provide an image forming system attending a wide variety of user needs, by being connected with a post-processing apparatus having various post-processing functions.

Such the image forming system, being capable of various post-processing, can be utilized in light printing field. In that case, producing a large number of processed sheets in unit time period (hereinafter referred as productivity) is required. And in many cases, the number of processed sheets of the image forming system is determined by a capacity of the post-processing apparatus rather than a capacity of the image forming apparatus.

To be more specific, in the post-processing apparatus, since there are many cases of executing the processing by temporarily stopping the conveyance of sheet, it is required to ensure a sufficient sheet interval when continuously ejecting the sheets from the image forming apparatus. As a measure to this case, conveyance speed in the post-processing apparatus is made higher than the conveyance speed in the image forming apparatus. However, in high speed technology of recent years, since the conveyance speed of the image forming apparatus is increasing, the increase of conveyance speed in the post-processing apparatus is coming near to a limitation.

In Patent document 1 (JP 2007-156406A) an apparatus is disclosed, which is provided with an overlapping section to accumulate a plurality of sheets in an intermediate conveyance unit disposed between an image forming apparatus and a post-processing apparatus, and concurrently conveys the plurality of accumulated sheets. In this way, by concurrently conveying the plurality of sheet in the overlapped state, the time to convey the sheets to the post-processing apparatus is delayed by the number of overlapped sheets. Thus, by lengthening the substantial sheet interval without increasing the conveyance speed, total productivity of the image forming system is improved.

In order to further improve the productivity, the conveyance speed of the image forming apparatus may be increased, and in order to execute various complex post-processing, the required processing time period may be increased. In these cases, the sheet interval is required to be increased.

According to the Patent Document 1, the substantial sheet interval is increased by overlapping the plurality of sheets, and in order to further ensure the longer sheet interval, it is required to increase the number of overlapping sheets. However, increasing the overlapping sheets to increase the number of sheets to be concurrently conveyed may cause to detract the stability and alignment in sheet conveyance, which may cause degradation of quality in the bookbinding. Further, in cases of thick sheets or sheets of smooth surface, it is difficult to increase the number of overlapping sheets.

In view of these problems, an objective of the present invention is, by increasing the number of overlapping sheets, to provide an image forming system capable of maintaining the stability and quality of sheet conveyance, as well as achieving the improvement of total productivity in the image forming system.

SUMMARY OF THE INVENTION

To achieve at least one of the abovementioned objects, an image forming system reflecting one aspect of the present invention includes:

an image forming section to print on sheets based on a print job including a plurality of page image data;

a conveyance path through which the sheets printed by the image forming section are conveyed;

a post-processing section which executes post-processing to form a booklet from a plurality of sheets conveyed through the conveyance path as a set unit;

a plurality of overlapping sections each of which is disposed between the image forming section and the post-processing section, makes the sheets temporarily wait, forms a bundle of sheets by overlapping a plurality of waiting sheets with each other, or by overlapping the waiting sheets with a sheet being conveyed through the conveyance path, and conveys the formed bundle of sheets to the post-processing apparatus;

a control section which, with respect to a second or later booklet set in case of continuously forming a plurality of booklet sets, controls a number of the plurality of sheets to be conveyed to the overlapping section, a conveying order of the sheets, and a timing to convey the formed bundle of sheets to a downstream side, based on a period of executing the post-processing by the post-processing section.

The image forming system reflecting another aspect of the present invention is the system described above, wherein the control section controls to convey the sheets out of the overlapping sections in sequence from an overlapping section disposed at a most downstream side in a conveyance direction, corresponding to the conveying order of the sheets to be conveyed to the post-processing section.

BRIEF DESCRIPTION OF THE DRAWINGS

These and other objects, advantages and features of the invention will become apparent from the following description thereof taken in conjunction with the accompanying drawings in which:

FIGS. 5*a*-5*b*5 are schematic diagrams to describe a sheet conveyance control with respect to the overlapping section st in a configuration of m=2 sheets, and n=2 units of overlapping section;

FIGS. 6*a*-6*b*7 are schematic diagrams to describe a sheet conveyance control with respect to the overlapping section st in a configuration of m=3 sheets, and n=2 units;

FIGS. 9*a*-9*b*5 are schematic diagrams to describe a sheet conveyance control with respect to the overlapping section st in a configuration of m=2 sheets, and n=2 units of overlapping section in the second embodiment;

FIGS. 10*a*-10*b*7 are schematic diagrams to describe a sheet conveyance control with respect to the overlapping section st in a configuration of m=3 sheets, and n=2 units in the second embodiment;

DETAILED DESCRIPTION OF THE PREFERRED EMBODIMENTS

Hereinafter, embodiments of the present invention will be described, however the present invention is not restricted to the embodiments.

Figure 1:
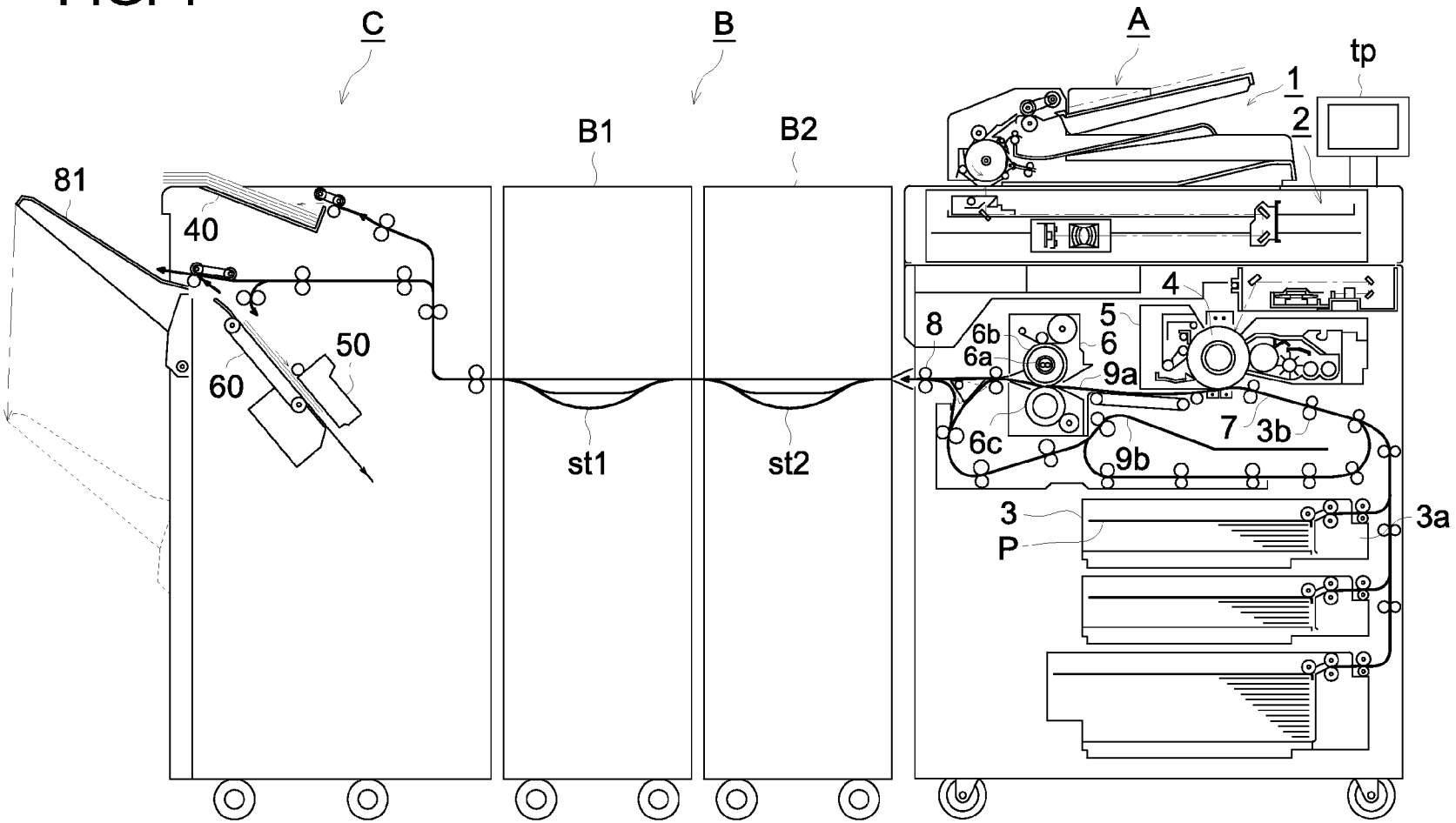
FIG. 1 is a diagram showing an overall configuration of an image forming system including image forming apparatus A, intermediate conveyance apparatus B, and post-processing apparatus C.

FIG. 1 is a diagram showing an overall configuration of an image forming system including image forming apparatus A, intermediate conveyance apparatus B, and post-processing apparatus C.

[Image forming Apparatus A]

Image forming apparatus A is provided, in an upper part, with automatic original document conveyance device 1 and image reading section 2, and the lower part is configured with a main body of the image forming apparatus.

In the image forming apparatus main body, code 3 indicates a sheet feeding tray to accommodate the sheet P. In image forming section 5 which forms a toner image on photosensitive member 4 by utilizing an electrophotographic process to perform charging, image exposing and development onto the photosensitive member 4, an image is formed on the sheet P, and the formed image is fixed by fixing unit 6. Fixing unit 6 forms a nip to convey the sheet P with heating roller 6*b* and pressure roller 6*c*. In heating roller 6*b*, heat source 6*a* is installed, and by controlling the heat generation amount of the heat source with using a temperature sensor (not illustrated), the heat roller 6*b* is controlled to be a certain temperature. While conveying the sheet P through the nip of fixing device 6, by melting the toner with heat-pressure, the toner image is fixed on the sheet P.

The sheet P is supplied from sheet feeding tray 3 to first feeding section 3*a*, and after temporarily stops at second feeding section 3*b*, conveyed and printed (image formation). The printed sheet P is ejected from an ejection slot by ejection roller 8.

As conveyance paths of the sheet P, provided are: sheet feeding path 7 from sheet feeding tray 3 to image forming section 5, conveyance path 9*a* from image forming section 5 through fixing unit 6 and ejection roller 8 to the ejection slot, and double face conveyance path 9*b* which reverses and switchbacks the sheet and conveys again to the sheet feeding path 7.

Code tp indicates an operation display section, which is configured with a display section of a liquid crystal panel arranged to superpose a touch screen. Through operations of the operation display section st, a user can set a setting of image forming apparatus A and a setting of output mode of post-processing apparatus C. Further, the user can set a paper weight and thickness of the sheet P, information of paper type and the like through the operation display section st.

[Intermediate Conveyance Apparatus B]

The sheet P ejected from the image forming apparatus A is conveyed to post-processing apparatus C through intermediate conveyance apparatus B.

In FIG. 1, two sets of intermediate conveyance apparatuses B1 and B2 are connected, and in each intermediate conveyance apparatuses B1 and B2 respectively arranged is overlapping section st1 and overlapping section st2. The overlapping section st1 and overlapping section st2 have similar configurations with each other. Hereinafter, in case of collectively referring these configurations, a reference code such as "st" or "B" will be described by omitting the last number code, and in case of referring each of the individual configurations, the reference codes will be described with adding the last number code in sequence from the downstream side, such as "st1, st2, . . . , stn" or "B1, B2".

Figure 2:
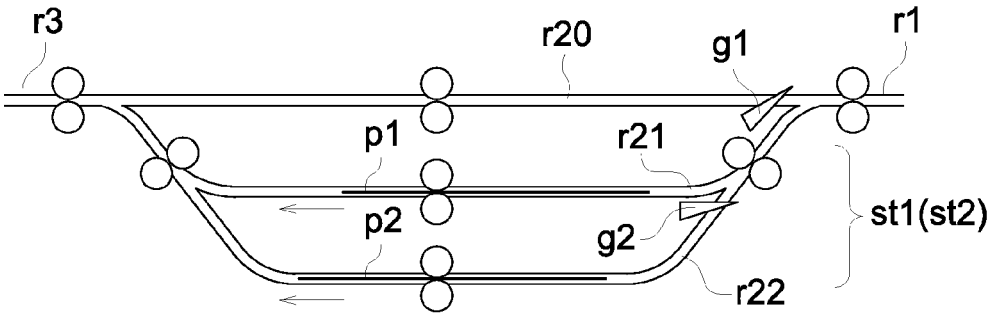
FIG. 2 is a schematic diagram showing an overlapping section st and its periphery of intermediate conveyance apparatus B.

FIG. 2 is a schematic diagram showing an overlapping section st and its periphery of intermediate conveyance apparatus B. Intermediate conveyance apparatus B is configured with sheet carrying-in section r1, sheet carrying-out section r3, and configurations, provided between r1 and r3, of conveying path r20, and overlapping section st. Further, the overlapping section st is configured with branch conveyance paths r21 and r22. In each conveyance path of bypath conveyance path r20 and branch conveyance paths r21, and r22, respectively provided is a roller pair, and each of the roller pair can be independently driven or stopped. The conveyance paths of branch conveyance paths r21 and r22 are used as waiting area. Switching to each conveyance path is executed by switching gates g1 and g2.

In case of directly conveying the sheet carried-in from image forming apparatus A, the sheet is conveyed through bypath conveyance path 120. In case of conveying by overlapping multiple sheets, by conveying two sheets of p1 and p2 respectively to branch conveyance paths 121 and r22, allowing to temporarily wait at each branch conveyance path, after that, by starting to convey the two sheets with synchronized timing, the sheets are overlapped such that each leading edge coincides with each other at a confluence site in the downstream side. The two sheets are conveyed to a subsequent post-processing apparatus C and the like, as a bundle set in an overlapped state.

In the example of FIG. 2, although branch conveyance paths r21 and r22 are used as overlapping section st, in a configuration having a plurality of overlapping sections st, the bypath conveyance path r20, which being another path of the overlapping section st at the most upstream side, can be used as the overlapping section st. Further by providing three or more branch conveyance sections, not being restricted by two, three or more sheet can be overlapped.

[Post-Processing Apparatus C]

Post-processing apparatus C as a post-processing section executes various post-processing on the sheet P which is carried-in as a set of sheets after being ejected from image forming apparatus A and overlapped with multiple sheets by intermediate conveyance apparatus B to be the set of sheets. Post-processing apparatus C exemplified in FIG. 1 has functions of side stitching and saddle stitching and center folding Other than these functions, post-processing apparatus may be functioned as a punching machine, a gluing and bookmaking machine, a cutting machine, and the like.

In post-processing machine C, first sheet ejection tray 40, processing tray 60 and staple section 50, are provided in sequence from upper side.

At processing tray 60, the sheet P printed by image forming apparatus A is temporarily stacked to form a bundle of sheets. After performing a vertical alignment process and width alignment process perpendicular to the vertical direction onto the sheets stacked on processing tray 60, staple section 50 performs a stapling process with a unit of set on the bundle of sheets to form a booklet. In processing tray 60, the sheet is stacked such that the surface printed by image forming apparatus A (the second surface, in the case of double side printing mode) comes to down side, and on the stacked sheet, a subsequent sheet is further stacked.

In FIG. 1, on the left side of the post-processing apparatus C, a movable second sheet ejection tray 81 is provided for ejecting and stacking the printed sheet.

[Control Block]

Figure 3:
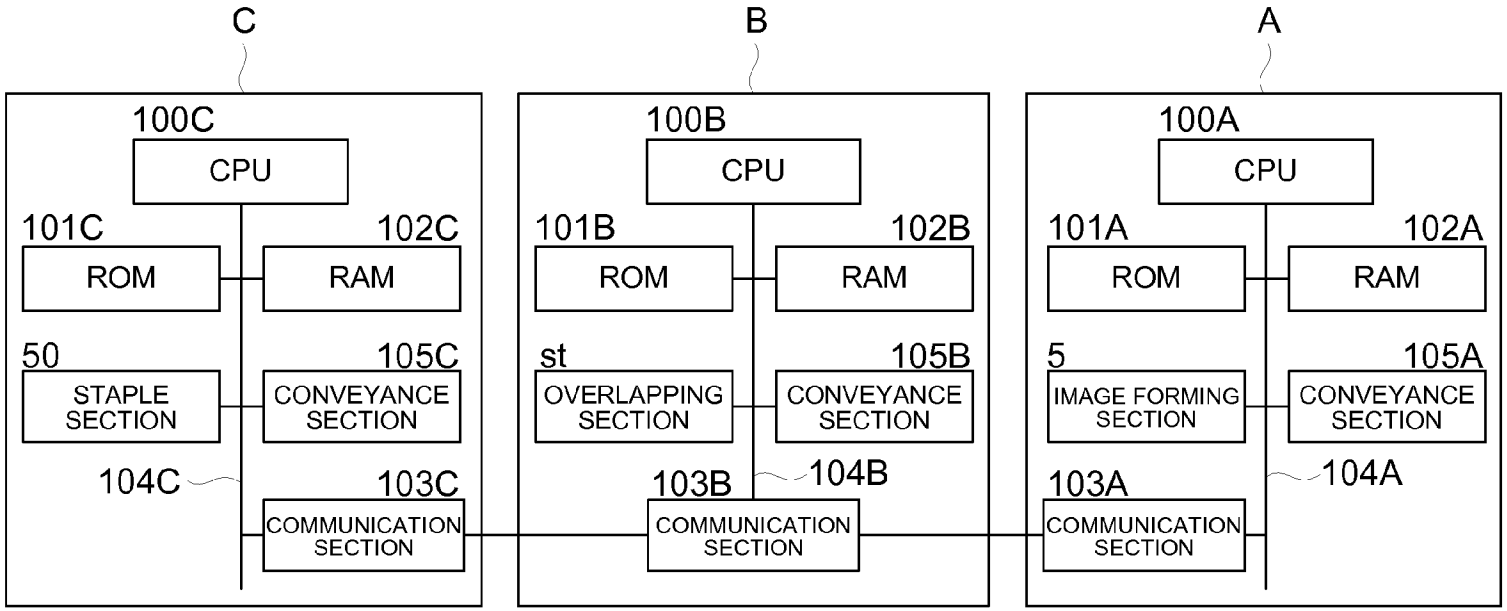
FIG. 3 is a block diagram of a control system of the image forming system.

FIG. 3 is a block diagram of a control system for the image forming system. In this diagram, parts necessary for describing the operation of the present embodiment and those peripheries are mainly described, and other usually known parts for the image forming system are omitted. In subsequent drawings, in order to avoid redundancy, common parts are given with the same code to substitute for explanations.

In image forming apparatus A, 100A being a CPU to execute overall various control of image forming apparatus A and the total image forming system. 101A is a ROM which stores various programs and data such as programs and data for controlling image forming apparatus A. 102 is a RAM as a memory section, being used by the CPU 100A as a work area, and temporarily stores the programs and data which are necessary for CPU 100A to control image forming apparatus A, and the like.

103A is a communication section to function as a communicating means, being connected with respective communication sections 103B and 103C of intermediate conveyance apparatus B and post-processing apparatus C, to execute communications. Through said communication section 103A, the required time for processing by post-processing apparatus can be obtained. 104A is a bus to connect ROM 101A, RAM 102A, communication section 103, and the like with each other. 105A is a conveyance section to convey the sheet by controlling the operations of a driving motor, a conveyance switching gate, and the like.

Conveyance section 105B of intermediate conveyance apparatus B executes the switching of sheet conveyance path and sheet conveyance by controlling the drive motor and switching gates g1 and g2. Other sections 100B-105B of the intermediate conveyance apparatus B and 100C-105C of the post-processing apparatus C correspond respectively to 100A-105A of the image forming apparatus A, and similarly function. CPU 100A or a combination of CPU 100A and CPU 100B works as a control section.

Control Flow in First Embodiment

Figure 4:
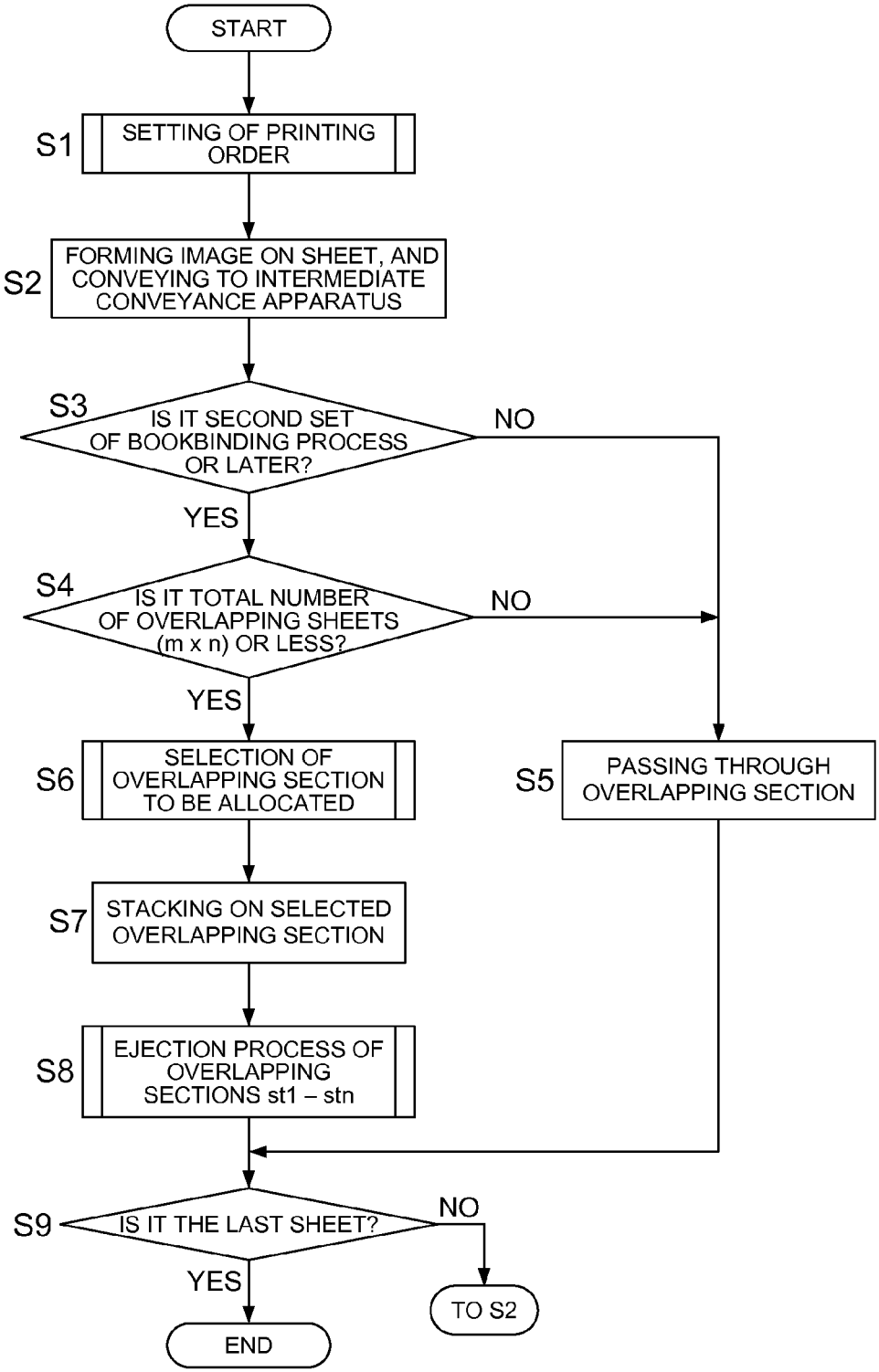
FIG. 4 is a control flow chart for an embodiment executed by the control section.

Next, a control flow will be described. FIG. 4 is a control flow for the embodiment executed by the control section. The control section executes the total control of the plurality of overlapping sections st. The control flow shown in FIG. 1 is for the case where there are n units of overlapping sections st, and shows the control flow at overlapping section st as a representative of overlapping sections st1, st2, . . . , stk (where $1 \leqq k \leqq n$). The flow in FIG. 4 is executed according to an input of a print job. The print job includes processing contents of the post-processing apparatus, print information such as the set number for executing the post-processing, and information of multiple page image data for printing on the sheet.

In step S1, setting of the printing order is executed.

Setting of Printing Order in the First Embodiment

Table 1 shows an example of setting the printing order, which shows the page number of page image data, to be printed by the image forming apparatus A, corresponding to the sheet to be sequentially printed from the first page (1p) in each set of second or subsequent set to j-th set (jp).

In the example shown in Table 1, which is an example of single side mode to print on one side of the sheet in the embodiment shown in FIG. 1, printing is executed in ascending order. This corresponds to the conveying order to convey into the post-processing apparatus. In case of double side printing mode, images of page image data for two pages are formed on a single sheet. Meanwhile, in a case where the configuration of overlapping section st is such that, as disclosed in JPA2007-156406, a plurality of sheets are overlapped in a stack section (waiting area) elongated in vertical direction, the overlapped sheets are front/back reversed by passing through a switchback, and conveyed to the post-processing apparatus at the downstream side, the conveying order of the sheet to the processing tray 60 of the post-processing apparatus is required to be a descending order, and accordingly the image forming order of the page image data becomes the descending order.

In the first embodiment, as shown in Table 1, on the first sheet (1P), the data of first page of the page image data is printed, and on the second or subsequent sheet, printing is executed by the page order of the page image data, and ejected from the image forming apparatus A with this order. In the first embodiment, since the setting of printing order is same as the case of not executing the overlapping process, the process of step S1 may be substantially omitted.

TABLE 1

| Image forming order n-th sheet (p) | Page image data (pd) |
|---|---|
| 1p | Pd1 |
| 2p | Pd2 |
| 3p | Pd3 |
| 4p | Pd4 |
| 5p | Pd5 |
| 6p | Pd6 |
| 7p | Pd7 |
| . . . | . . . |
| jp | pdj |

In step S2, image forming apparatus A prints on the sheets by the order shown in Table 1 having been set in step S1, and ejects toward intermediate conveyance apparatus B.

IN step S3, the control section determines whether or not it is the second or later set of bookbinding process to be executed by post-processing apparatus C. Wherein the "set" means a unit for executing the post-processing, for example in a case of forming 10 sets of booklets by assuming a unit to be 50 sheets and using 500 sheets of paper, among the sheets ejected from the image forming apparatus A to the intermediate conveyance apparatus B, the sheets from first to $50^{th}$ become the first set of sheets, and the second or later set includes the $51^{st}$ and subsequent sheets.

In the present embodiment the sheet is overlapped at the overlapping section st, in order to avoid that the subsequent sheet is conveyed into the post-processing apparatus C in the act of executing the post-processing. Therefore, if it is the second or subsequent set (step S3: Yes), it becomes an object to be executed with the overlapping process, and the flow proceeds to step S4.

In step S4, the control section determines whether or not the number of sheets ejected from the image forming apparatus is a total number of overlapping sheets or less. Wherein, the total number of overlapping sheets is the total number of sheets to be overlapped by all the overlapping sections st. In the control flow shown in FIG. 4, the total number of overlapping sheets is assumed to be a fixed number of sheets (=m×n), where "m" is a maximum number of sheets capable of overlapping at one overlapping section st, and "n" is the number of overlapping sections st installed in the image forming system. Although the total number of overlapping sheets is to be set based on post-processing execution time, in the present embodiment, post-processing execution time is assumed to be fixed time. In an embodiment where a plurality of post-processing functions are provided in the post-processing apparatus C, and plural types of post-processing are executable, the processing time may differ by the post-processing. In such case, the total number of overlapping sheets may be made variable in a range from 2 sheets to (m×n) sheets corresponding to the post-processing execution time by each post-processing type specified by the print job.

On the other hand, if No in step S3 or step S4, without executing the overlapping process, in step S5, the sheet P is conveyed to bypath conveyance path r20 from every overlapping sections st to pass through.

In step S4, if it is before reaching to the total number of overlapping sheets, the flow goes to step S6. In step S6, the control section selects the overlapping section st to be allocated with the sheet among the plurality of overlapping sections.

Onto the overlapping section st(k), which being k-th overlapping section from the most downstream side among the plurality of overlapping sections st, the sheet formed with the image of page image data shown in Expression (1) described below is allocated (1≦k≦n).

$$\{m\times(k-1)+1\}\sim(m\times k) \qquad \text{Expression (1)}$$

Tables 2 and 3 show the number order (p) of the sheet to be allocated to each overlapping section st, and the page number of the page image data (pd). For example, if the maximum number of sheets m=2 and the number of overlapping sections st n=2, the sheets to be allocated to the overlapping section st1 (k=1) are the sheets formed with the page image data from $1^{st}$ page to $2^{nd}$ page (pd1~pd2), and the sheets to be allocated to the overlapping section st2 (k−2) are similarly the sheets formed with the page image data from $3^{rd}$ page to $4^{th}$ page (pd1~pd2). In a case where m=3 and n=2, (p) and (pd) they become as shown in Table 3.

TABLE 2

| Maximum sheet number m = 2, Unit n = 2 | |
|---|---|
| st1 | st2 |
| 1p (pd1) | 3p (pd3) |
| 2p (pd2) | 4p (pd4) |

TABLE 3

| Maximum sheet number m = 3, Unit n = 2 | |
|---|---|
| st1 | st2 |
| 1p (pd1) | 4p (pd4) |
| 2p (pd2) | 5p (pd5) |
| 3p (pd3) | 6p (pd6) |

FIGS. 5*a*-5*b*5 are schematic diagrams to explain the conveyance control of the sheet with respect to the overlapping section st in configuration of m=2 sheets, and n=2 units. FIGS. 6*b*-6*b*7 are schematic diagrams to explain the conveyance control of the sheet with respect to the overlapping section st in configuration of m=3, and n=2. These are respectively corresponding to Table 2, and Table 3.

FIG. 5*a* is a schematic diagram showing the total flow, where the first and second sheets respectively printed with the page image data of first and second pages are allocated to the overlapping section st1, and the third and fourth sheets respectively printed with the page image data of third and fourth pages are allocated to the overlapping section st2. While, as shown in the above described flow step S5, the fifth or subsequent sheet in the set is conveyed through bypath conveyance path r20 and is passed through the overlapping section st.

FIG. 5*b*1-FIG. 5*b*5 are diagrams to show the conveyance control of sheet P in case of conveying the sheet in the overlapping sections st1 and st2 in the configuration shown in FIG. 5*a*. FIGS. 5*b*1 to 5*b*5 are aligned in chronological order such that between the successive diagrams, the sheet interval period Ti is elapsed. Wherein the sheet interval Ti means the conveyance cycle of sheet P conveyed from the image forming apparatus A, for example, in case of the image forming apparatus A having throughput of 120 sheets/minute, the sheet interval Ti is 0.5 sec.

By the processes of FIGS. 5*b*1-5*b*3, two sheets are stacked for waiting on the overlapping section st1. Similarly, by the processes of FIGS. 5*b*3-5*b*4, two sheets are stacked for waiting on the overlapping section st2.

Figure 6A:
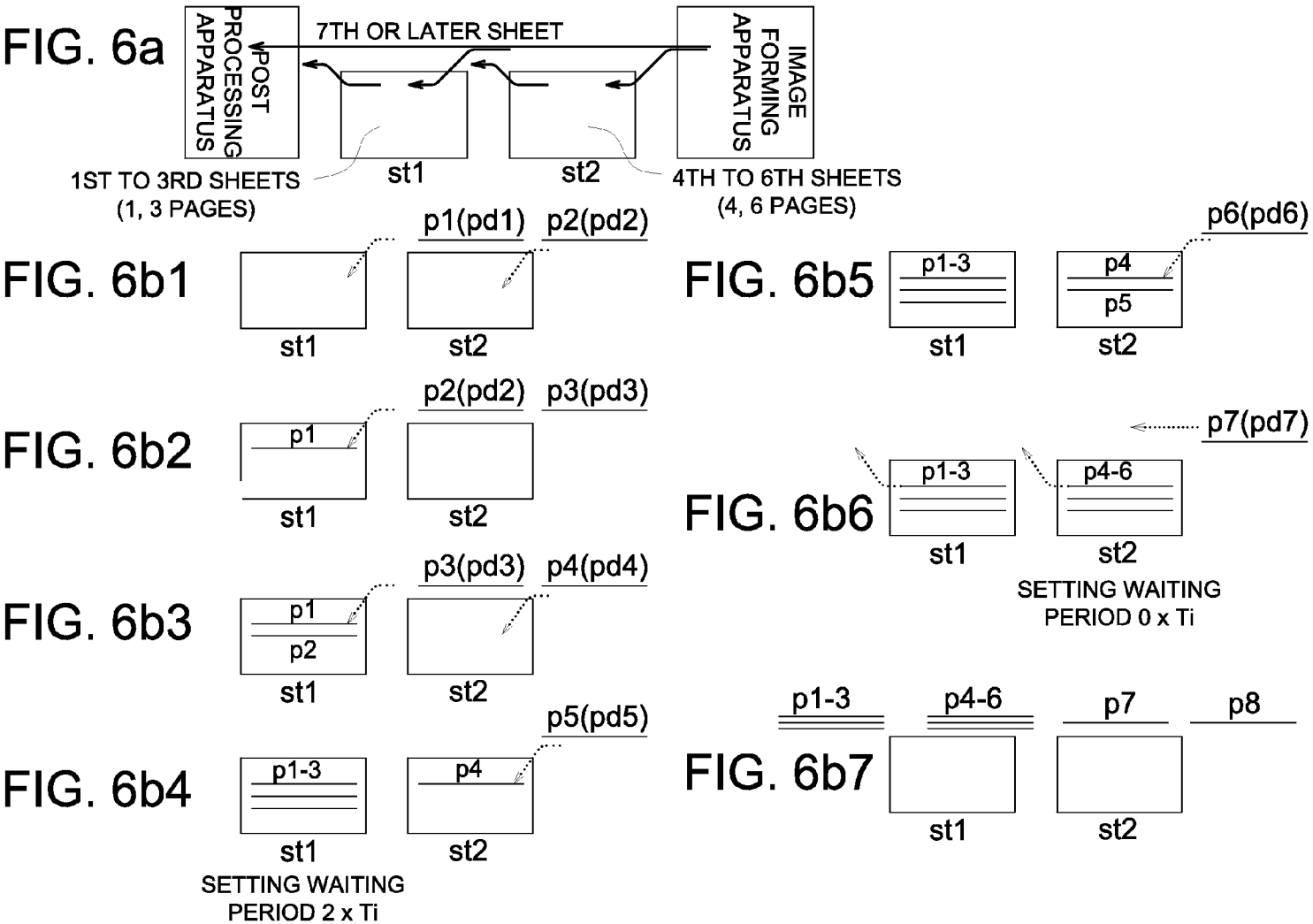

Similarly, FIG. 6*a* is a schematic diagram showing the total flow, where the first to third sheets respectively printed with the page image data of first to third pages are allocated to the overlapping section st1, and the fourth to sixth sheets respectively printed with the page image data of fourth to sixth pages are allocated to the overlapping section st2. While, as shown in the above described flow step S5, the seventh or subsequent sheet in the set is conveyed through bypath conveyance path r20 and is passed through the overlapping section st. And, by the processes of FIGS. 6*b*1-6*b*4, three sheets are stacked for waiting on the overlapping section st1. Similarly, by the processes of FIGS. 6*b*3-6*b*6, three sheets are stacked for waiting on the overlapping section st2.

Sheet Ejection Process in the First Embodiment

Returning to the description of FIG. 4, in the step of S8 in FIG. 4, the ejection process of overlapping sections st is executed. The subroutine of said step S8 is shown in FIGS. 7 and 8.

Figure 7B:
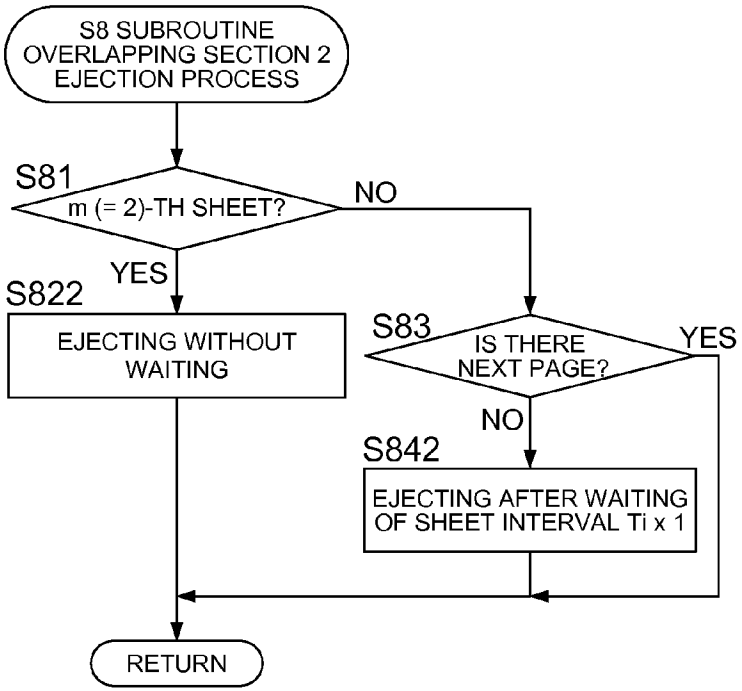
FIGS. 7*a*-7*b* are subroutines of step S8 in a configuration of m=32 sheets, and n=2 units.
Figure 7A:
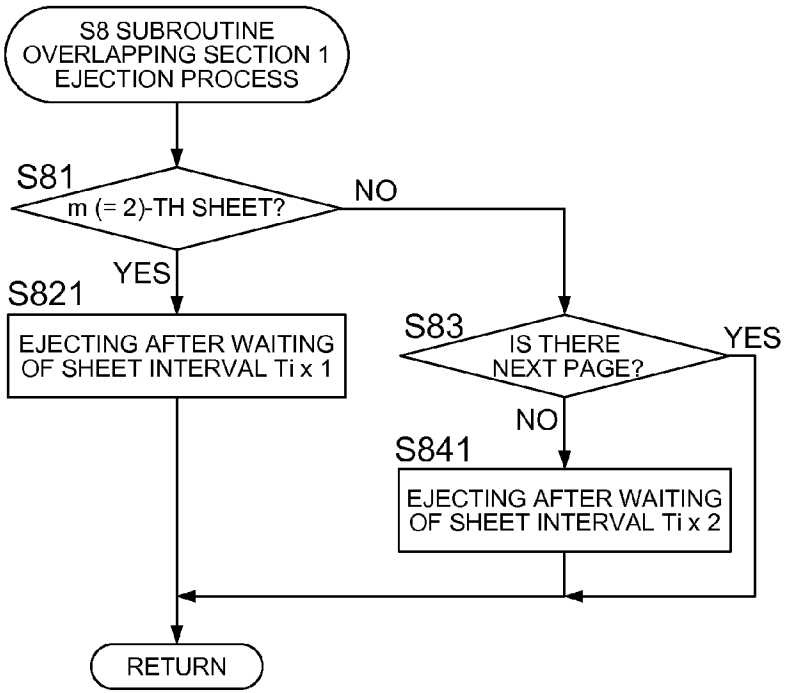
Figure 8:
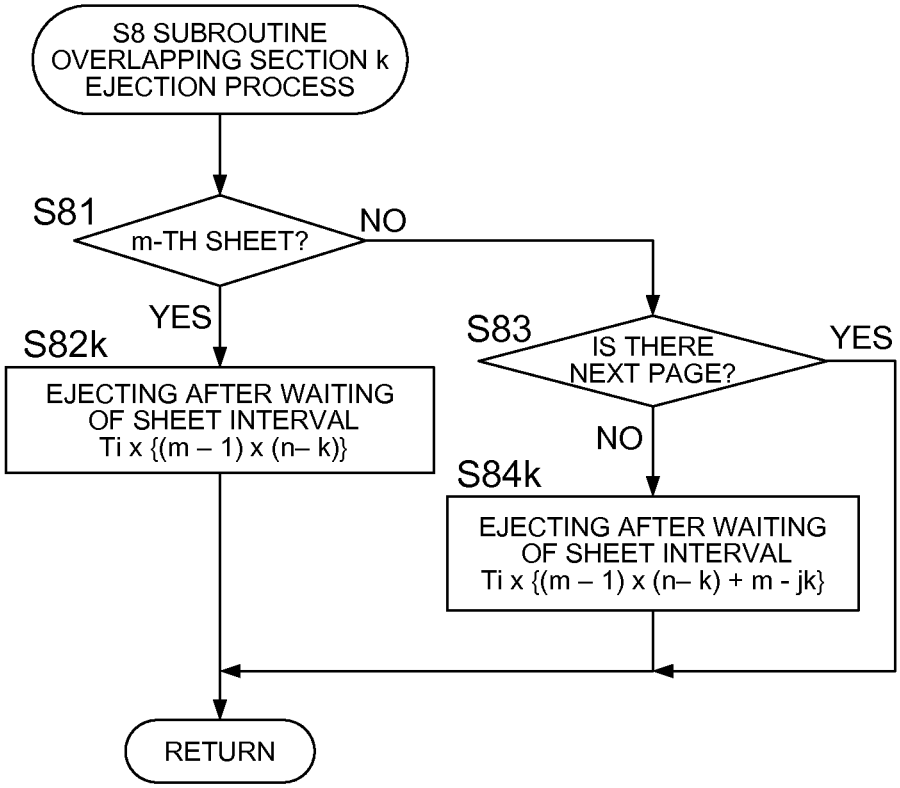
FIG. 8 is a subroutine process of step S8 at the k-th overlapping section from the down stream side, with respect to an image forming system in a configuration of maximum number of sheets being m, and n units of overlapping section.

FIGS. 7*a* and 7*b* are subroutines of step S8 in the configuration shown in FIG. 5*a* when m=2 sheets, and n=2 units. FIG. 7*a* shows the process in overlapping section st1 at the most downstream side, and FIG. 7*b* shows the process in the second overlapping section st2 from most downstream side. FIG. 8 is a generalized subroutine of these cases, showing the subroutine of step S8 at the k-th overlapping section from the down stream side in the case where the maximum sheet number is m sheets, and the number of overlapping sections is n units. Wherein, in these figures, a same code is attached to the same process to omit a redundant explanation.

In the step S81 of FIG. 7*a*, the control section determines whether or not the sheet number reached to the maximum number of sheets m=2, and if having reached to the maximum number of sheets m (step S81: Yes), the control section makes the sheets wait for a sheet interval Ti (waiting process), and after the elapse of the waiting period, ejects the sheets of the waiting area with overlapped state.

The process of step S83 and the subsequent step relate to an odd number process to be executed in cases where number of sheets in the set is less than the total number of overlapping sheets (m×n). In the case when number of sheets in the set is less than the total number of overlapping sheets (m×n), and the control section determines that the subsequent sheet is not conveyed to the overlapping section st1 (step S83: No), in the step S841, the sheets are made wait during the sheet interval Ti for two sheets (Ti×2), and after the elapse of said waiting period, the sheets in the waiting area are ejected.

The flows to be executed in the overlapping section st2 shown in FIG. 7*b*, and in the overlapping section stk shown in FIG. 8 are similar to the flow of FIG. 7*a*, except for the waiting times at the steps S822 and S842 being different. In the first embodiment, as shown in the step S82*k* of FIG. 8, after the m-th sheet of the maximum number of sheets is conveyed into the waiting area of the overlapping section stk, the sheets are made wait during the sheet interval Ti multiplied by the number of sheets, calculated by the expression (2) below, and ejected in a bundle.

$$Ti\times(m-1)\times(n-k) \qquad \text{Expression (2)}$$

In the odd process of step S842, the sheets are made wait during the sheet interval Ti multiplied by the number of sheets, calculated by the expression (3) below, and ejected in a bundle. Wherein, in the Expression (3), "jk" is a variable (1≦jk≦m) corresponding to the number of sheets stacked for waiting in the overlapping section stk at the time of determination in the step.

$$Ti\times\{(m-1)\times(n-k)+m-jk\} \qquad \text{Expression (3)}$$

The processes of waiting periods in the steps S821 and S822 of FIGS. 7*a* and 7*b* are schematically shown in FIGS. 5*b*3 and 5*b*4. FIG. 5*b*3 shows the setting of the sheet interval Ti at the time when the second sheet, which is the m-th in maximum m sheets, is stacked to wait in the overlapping section st1. And, after the period having elapsed, FIG. 5*b*4 shows the ejection of the sheets from the waiting area. With respect to the overlapping section st2, after the second sheet, which is the maximum m-th (second) sheet, is stacked to wait in FIG. 5*b*4, the stacked sheets are immediately ejected without the waiting time.

Returning to the explanation of FIG. 4, after executing the ejection process by the control of step S8, the control section determines whether or not the conveyed sheet is the last sheet of the print job, and repeats to execute the steps of S2 and subsequent steps.

According to the present embodiment, in the image forming system where the control section is capable of totally controlling a plurality of overlapping sections st as a unit, by controlling a number of the plurality of sheets being conveyed to the overlapping section, an order of conveying the sheets, and a timing to convey the formed bundle of sheets to a downstream side, based on a period of executing a post-processing by the post-processing section C, the effects described below can be achieved.

(1) In the conventional case of increasing the total number of overlapping sheets by utilizing one unit of overlapping section, at the time of conveying the sheets in a state of bundle of sheets, the number of sheets in the bundle of sheets is increased, which may cause to detract the stability and deteriorate the sheet edge setting accuracy to worsen the alignment of the conveyed sheets, and lead to the deterioration of bookbinding quality. On the other hand, according to the present embodiment, even in case of large number of overlapping sheets, since the sheets are distributed to the plurality of bundles of sheets, the increase of the number of sheets in one bundle of sheets can be suppressed to prevent the above problem.

(2) Further, in the case where the sheet type is difficult to increase the number of bundle sheets such as thick sheets or sheets of highly smooth surface, since the maximum number of total overlapping sheets is restricted in a configuration of single overlapping section, the productivity of the system is decreased. However, according to the present embodiment, by increasing the number of overlapping sections, the maximum number of overlapping sheets is not limited.

(3) In case of increasing the total number of overlapping sheets by increasing the maximum number of sheets (m) of one overlapping section, at the time of executing the odd number process (refer to the odd number process of step S83) in conditions that the sheets number in one set of bookmaking being less than the maximum number of sheets m, the number of applicable overlapping patterns increases, which makes the control complicated and increases the cost for development. On the other hand, according to the present embodiment, since the maximum number of sheets can be small in one overlapping section, the number of applicable overlapping patterns becomes small, which enables a comparatively simple control to avoid the increase of development cost.

Control Flow in the Second Embodiment

Next, the control flow of the second embodiment will be described. In the second embodiment, a printing order of page image data of a print job is changed, and corresponding to the change, controlled are the number of sheets to be conveyed into each overlapping section st, the order of conveyance, and the timing to convey the formed bundle sheets toward the downstream side. In the second embodiment, the control flow of FIG. 4 is also executed, and except for the contents described below, the process is similar to the first embodiment

Setting of Printing Order in the Second Embodiment

In the second embodiment, the setting of printing order is also executed in the step S1. Tables 4 and 5 are examples of printing order setting, and shows the number of page in the page image data to be printed by the image forming apparatus A, corresponding to the sheets to be printed in the order from first sheet (1P) to j-th sheet (jp) of the second or later set.

In the second embodiment, according to maximum number of sheets m and number of units n, the printing order of the page image data is changed. Table 4 shows a setting example in the configuration of m=2, and n=2, and Table 5 shows a setting example in the configuration of m=3, and n=2. Wherein, in Table 4 and Table 5, the range of equal to or less than the total number of overlapping sheets (in the example of the Tables: m×n) is the subject region of printing order setting (the fourth or previous sheet in Table 4, and the fifth or previous sheet in Table 5). The region later than the total number of overlapping sheets (5-th or later sheet in Table 4, and 7-th or later sheet in Table 5) are not the subject region of changing the printing order. In the non subject region, the printing order and the page number in the page image data coincide with each other.

TABLE 4

| Maximum sheet number m = 2, Unit n = 2 | |
|---|---|
| Image forming order n-th sheet (p) | Page image data (pd) |
| 1p | Pd1 |
| 2p | Pd3 |
| 3p | Pd2 |
| 4p | Pd4 |
| 5p | Pd5 |
| 6p | Pd6 |
| 7p | Pd7 |
| . . . | . . . |
| jp | pdj |

TABLE 5

| Maximum sheet number m = 3, Unit n = 2 | |
|---|---|
| Image forming order n-th sheet (p) | Page image data (pd) |
| 1p | Pd1 |
| 2p | Pd4 |
| 3p | Pd2 |
| 4p | Pd5 |
| 5p | Pd3 |
| 6p | Pd6 |
| 7p | Pd7 |
| . . . | . . . |
| jp | pdj |

With respect to the steps S2 to S5, the processes are similar to those in the first embodiment, and the explanation is omitted. In the step S6, the selection of allocating to which of the plurality of overlapping sections is executed, and in the step S7, the sheet is stacked to wait in the overlapping section selected in the step S7.

In the step S6, onto the overlapping section st(k), which being k-th overlapping section from the most downstream side among the plurality of overlapping sections st, the sheet formed with the image of page image data shown in Expression (1) described below is allocated ($1 \leqq k \leqq n$).

$$\{m\times(k-1)+1\}\sim(m\times k) \qquad \text{Expression (1)}$$

In the first and second embodiments, Expression (1) is common, and the sheets formed with the image of the same page image data are allocated to the same overlapping section st. However, as being clear from comparison of Table 1 and Table 4, the printing order of each page image data is different, and corresponding to this, the order of allocation of the sheets conveyed from the image forming apparatus is different. By referring to Tables 6 and 7, and FIGS. 9 and 10, the explanation will be followed below.

TABLE 6

| Maximum sheet number m = 2, Unit n = 2 | |
|---|---|
| st1 | st2 |
| 1p (pd1) | 2p (pd3) |
| 3p (pd2) | 4p (pd4) |

TABLE 7

| Maximum sheet number m = 3, Unit n = 2 | |
|---|---|
| st1 | st2 |
| 1p (pd1) | 2p (pd4) |
| 3p (pd2) | 4p (pd5) |
| 5p (pd3) | 6p (pd6) |

Figure 10A:
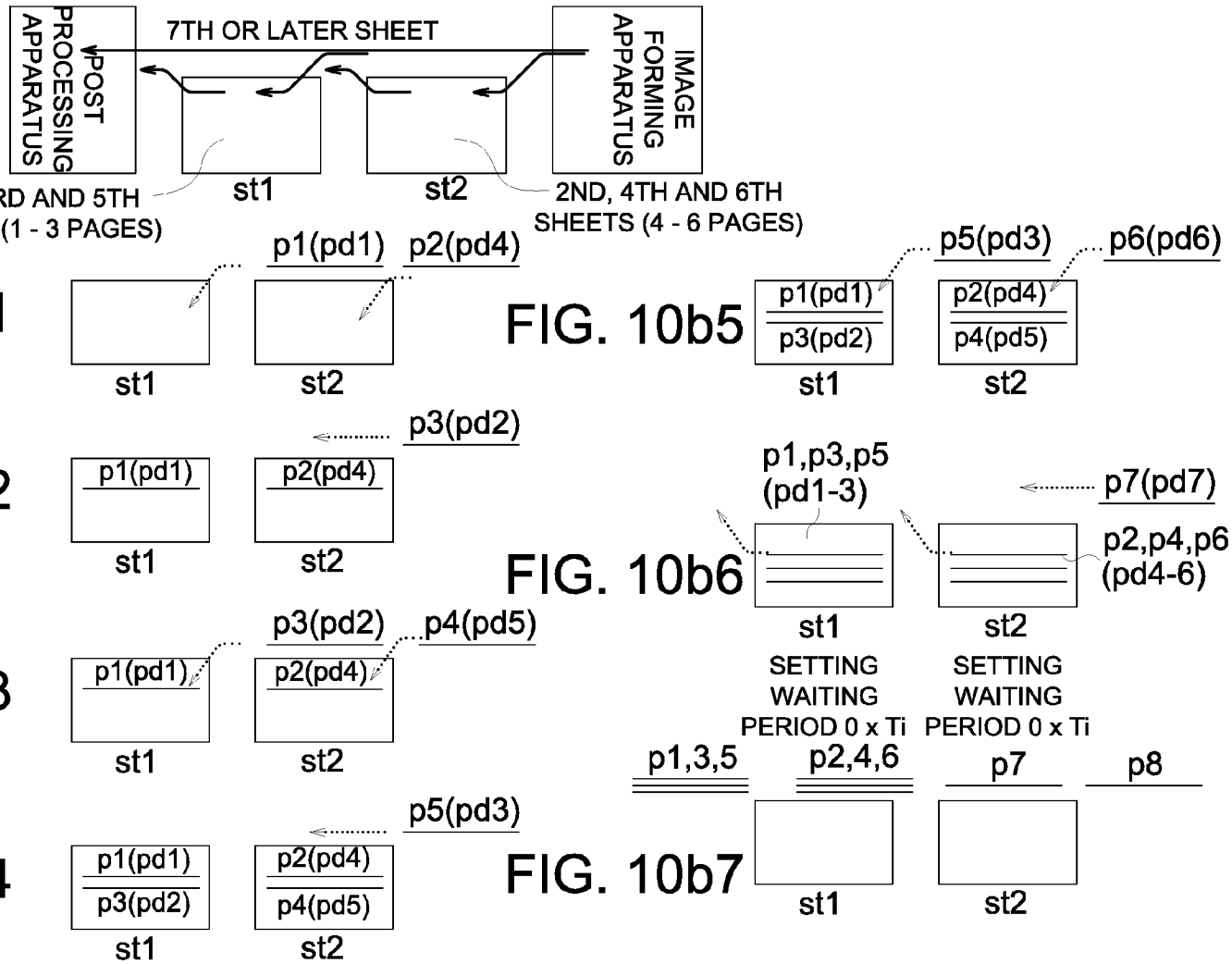

Tables 6 and 7 are respectively corresponding to Tables 2 and 3, showing the order number (p) of the sheets to be allocated to each overlapping section st, and the page number (pd) of the page image data. FIGS. 10*a*-10*b*7 are schematic diagrams to explain the conveyance control of the sheet with respect to the overlapping section st in configuration of m=3, and n=2, corresponding to Table 7.

For example, in the case where the maximum sheet number m=2, and the number of overlapping sheets n=2, as shown in Table 6, the sheets to be allocated to the overlapping section st1 (k=1) are the first and third sheets (1p and 3p) formed with images of the page image data of first to second page (pd1 to pd2), and the sheets to be allocated to the overlapping section st2 (k=2) are the second and fourth sheets (2p and 4p) similarly formed with images of the page image data of third to fourth page (pd3 to pd4).

FIG. 9*a* is a schematic diagram showing the total flow, where as shown in Table 6, the first and third sheets respectively printed with the page image data of first and second pages are allocated to the overlapping section st1, and the second and fourth sheets respectively printed with the page image data of third and fourth pages are allocated to the overlapping section st2. While, as shown in the above described flow step S5, the fifth or later sheet in the set is conveyed through bypath conveyance path r20 and is passed through the overlapping section st.

Similarly in FIGS. 10*a*-10*b*7, FIG. 10*a* is a schematic diagram showing the total flow, where as shown in Table 7, the first, third and fifth sheets respectively printed with the page image data of first to third pages are allocated to the overlapping section st1, and the second, fourth and sixth sheets respectively printed with the page image data of fourth to sixth pages are allocated to the overlapping section st2. While, as shown in the above described flow step S5, the seventh or later sheet in the set is conveyed through bypath conveyance path r20 and is passed through the overlapping section st.

As the other example, the setting example of printing order in the configuration of m=2 and n=3 is shown in Table 8, and the relationship between the order of sheet (p) to be allocated to each overlapping section st and the page number (pd) of the page image data is shown in Table 9. As shown in Table 9, the sheets to be allocated to the overlapping section st1 (k=1) are the first and fourth sheets (1p and 4p) formed with images of the page image data of first to second page (pd1 to pd2), the sheets to be allocated to the overlapping section st2 (k=2) are the second and fifth sheets (2p and 5p) formed with images of the page image data of third to fourth page (pd3 to pd4), and the sheets to be allocated to the overlapping section st3 (k=3) are the third and sixth sheets (3p and 6p) formed with images of the page image data of fifth to sixth page (pd5 to pd6).

TABLE 8

| Maximum sheet number m = 2, Unit n = 3 | |
|---|---|
| Image forming order n-th sheet (p) | Page image data (pd) |
| 1p | Pd1 |
| 2p | Pd3 |
| 3p | Pd5 |
| 4p | Pd2 |
| 5p | Pd4 |
| 6p | Pd6 |
| 7p | Pd7 |
| . . . | . . . |
| jp | pdj |

TABLE 9

| Maximum sheet number m = 2, Unit n = 3 | | |
|---|---|---|
| st1 | st2 | st3 |
| 1p (pd1) | 2p (pd3) | 3p (pd5) |
| 4p (pd2) | 5p (pd4) | 6p( pd6) |

Sheet Ejection Process in the Second Embodiment

In the step of S8, the ejection process of overlapping sections st is executed. The subroutine of said step S8 in the second embodiment is shown in FIGS. 11*a*, 11*b* and 12, which correspond to FIGS. 7*a*, 7*b* and 8.

Figure 11A:
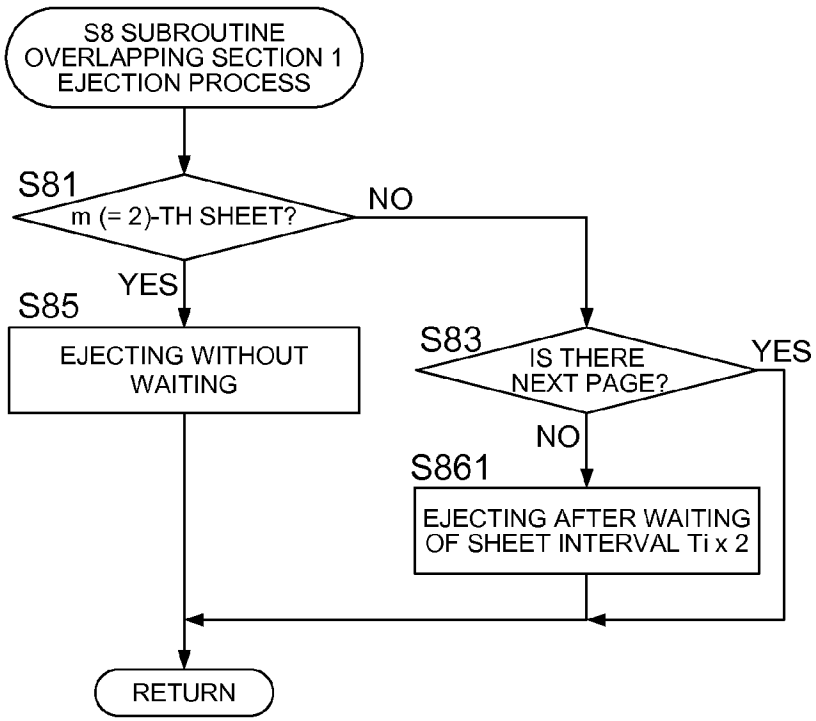
FIGS. 11*a*-11*b* are subroutines of step S8 in a configuration of m=3 sheets, and n=2 units in the second embodiment.
Figure 11B:
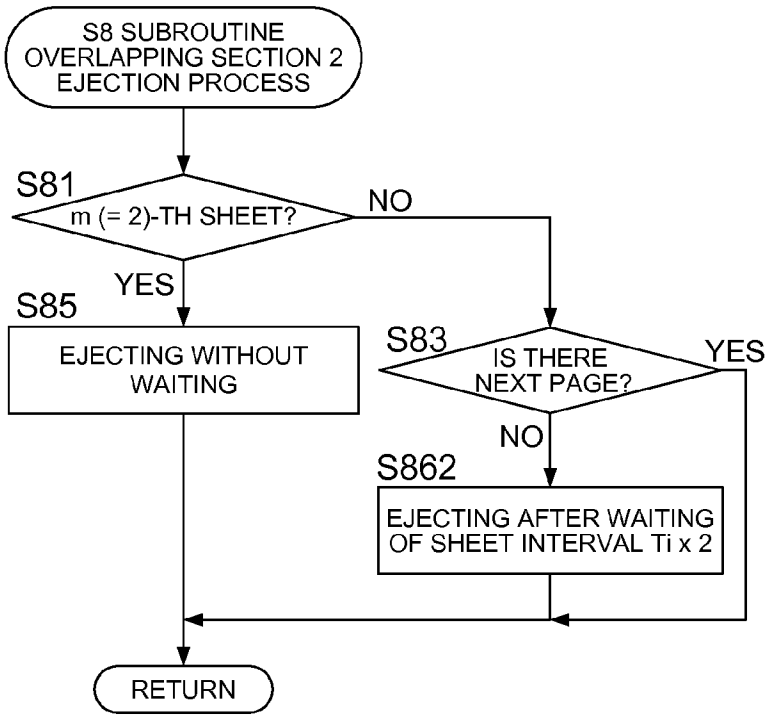

FIGS. 11*a* and 11*b* are subroutines of step S8 in the configuration shown in FIG. 9 when m=2 sheets, and n=2 units. FIG. 11*a* shows the process in overlapping section st1 at the most downstream side, and FIG. 11*b* shows the process in the second overlapping section st2 from most downstream side. FIG. 12 is a generalized subroutine of these cases, showing the process at the k-th overlapping section from the most downstream side in the case when the maximum sheet number is m sheets, and the number of overlapping sections is n units.

Figure 12:
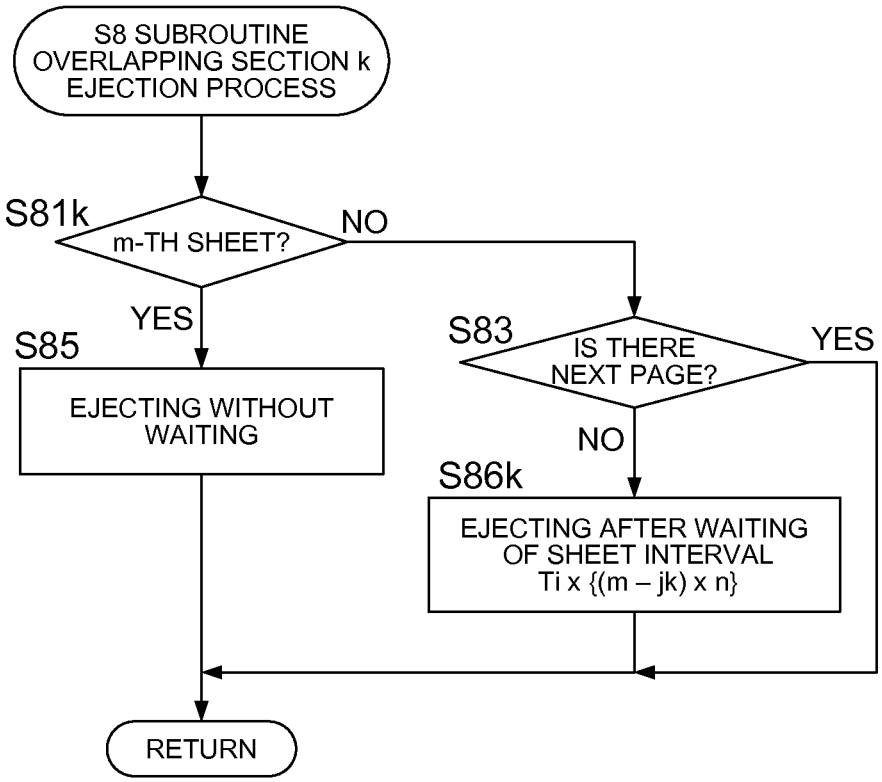
FIG. 12 is a subroutine process of step S8 at the k-th overlapping section from the down stream side, with respect to an image forming system in a configuration of maximum number of sheets being m, and n units of overlapping section in the second embodiment.

Different from the first embodiment as shown in FIGS. 7*a*, 7*b* and 8A, according to the second embodiment as shown in FIGS. 11*a*, 11*b* and 12, the step S85 shown in FIGS. 11*a*, 11*b* and 12 is a common control for every overlapping sections st, namely, the m-th sheet of the maximum sheet number can be ejected without waiting time, immediately after having been stacked at every overlapping sections st.

With respect to the odd number processes of step S83 and later, all the processes in FIGS. 11*a*, 11*b*, and 12 are also common, and the common control is executed in every overlapping sections st.

According to the second embodiment, in addition to the effects of first embodiment, the control flow regarding the sheet ejection process can be made common to every overlapping sections st, which enables a further simple control compared to the first embodiment to avoid the increase of development cost.

EXPLANATION OF CODES

| | |
|---|---|
| A: | Image forming apparatus |
| 5: | Image forming section |
| B, B1, B2: | Intermediate conveyance apparatus |
| st, st1, st2: | Overlapping section |
| r20: | Bypath conveyance path |
| r21, r22: | Branch conveyance path |
| C: | Post-processing apparatus |
| 50: | Staple section |
| 60: | Processing tray |
| 80: | Second sheet ejection tray |

What is claimed is:

1. An image forming system comprising:

an image forming section to print on sheets based on a print job including a plurality of page image data;

a conveyance path through which the sheets printed by the image forming section are conveyed;

a post-processing section which executes post-processing to form a booklet from a plurality of sheets conveyed through the conveyance path as a set unit;

a plurality of overlapping sections each of which is disposed between the image forming section and the post-processing section, makes the sheets temporarily wait, forms a bundle of sheets by overlapping a plurality of waiting sheets with each other, or by overlapping the waiting sheets with a sheet being conveyed through the conveyance path, and conveys the formed bundle of sheets to the post-processing apparatus;

a control section which, with respect to a second or later booklet set in case of continuously forming a plurality of booklet sets, controls a number of the plurality of sheets to be conveyed to the overlapping section, a conveying order of the sheets, and a timing to convey the formed bundle of sheets to a downstream side, based on a period of executing the post-processing by the post-processing section.

2. The image forming system of claim 1, wherein the control section controls to convey the sheets out of the overlapping sections in sequence from an overlapping section disposed at a most downstream side in a conveyance direction, corresponding to the conveying order of the sheets to be conveyed to the post-processing section.

3. The image forming system of claim 2, wherein the control section controls to convey the sheets out of the overlapping sections in sequence from an overlapping section disposed at a most of downstream side in a conveyance direction, corresponding to a page order for forming the booklet.

4. The image forming system of claim 3, wherein in cases where a number of the overlapping sections is n ($n \geqq 2$), and a maximum number of sheets of the bundle of sheets capable of being formed by the overlapping section is m ($m \geqq 2$), the control section allows the image forming section to form images of each set with the page order of the page image data of the print job, and controls to convey the sheet formed with $\{m \times (k-1)+1\}$-th through $(m \times k)$-th page image of the page image data into the k-th overlapping section ($1 \leqq k \leqq n$) from the bottom of downstream side in a conveyance direction, and to convey the bundle of sheets toward the downstream side after making the sheets wait, at each overlapping section, during sheet intervals for $(m-1) \times (n-k)$ sheets from a time when the last sheet to form the bundle of sheets is conveyed-in.

5. The image forming system of claim 2, the control section changes a printing order of the page image data in the print job with respect to the sheets forming the bundle of sheets.

6. The image forming system of claim 5, wherein in cases where a number of the overlapping sections is n ($n \geqq 2$), and a maximum number of sheets of the bundle of sheets capable of being formed by the overlapping section is m ($m \geqq 2$), the control section allows the image forming section to form images with a print order of the page image data on 1 through ($m \times n$) pages as: 1, $(m \times 1)+1, \ldots, m \times (n-1)+1$, 2, $(m \times 1)+2, \ldots, m \times (n-1)+2$, m, $m \times 2, \ldots, m \times n$; and controls to convey the sheet formed with $\{m \times (k-1)+1\}$th through ($m \times k$)th page image of the page image data into the k-th overlapping section ($1 \leqq k \leqq n$) from a bottom of downstream side in a conveyance direction, and to convey the bundle of sheets toward the downstream side without making the sheets wait, when the last sheet to form the bundle of sheets is conveyed-in.

* * * * *

UNITED STATES PATENT AND TRADEMARK OFFICE

CERTIFICATE OF CORRECTION

PATENT NO. : 8,469,348 B2
APPLICATION NO. : 13/344794
DATED : June 25, 2013
INVENTOR(S) : Yasushi Saitsu It is certified that error appears in the above-identified patent and that said Letters Patent is hereby corrected as shown below:

On the Title page; Item (57) Abstract, line 4:
replace "booldet" with --booklet--.

On the Title page; Item (57) Abstract, line 11:
replace "booldet" with --booklet--.

On the Title page; Item (57) Abstract, line 12:
replace "booklet" with --booklet--.

Signed and Sealed this
Nineteenth Day of November, 2013

Teresa Stanek Rea

Teresa Stanek Rea
*Deputy Director of the United States Patent and Trademark Office*